US011162303B2

(12) United States Patent
Perry et al.

(10) Patent No.: US 11,162,303 B2
(45) Date of Patent: Nov. 2, 2021

(54) ROTARY STEERABLE TOOL WITH PROPORTIONAL CONTROL VALVE

(71) Applicant: APS Technology, Inc., Wallingford, CT (US)

(72) Inventors: Carl A. Perry, Middletown, CT (US); William E. Breuer, Jr., Cromwell, CT (US); Serhiy Korostensky, Fairfield, CT (US)

(73) Assignee: APS Technology, Inc., Wallingford, CT (US)

( * ) Notice: Subject to any disclaimer, the term of this patent is extended or adjusted under 35 U.S.C. 154(b) by 200 days.

(21) Appl. No.: 16/441,930

(22) Filed: Jun. 14, 2019

(65) Prior Publication Data

US 2020/0392790 A1 Dec. 17, 2020

(51) Int. Cl.
*E21B 34/06* (2006.01)
*E21B 44/00* (2006.01)
(Continued)

(52) U.S. Cl.
CPC ..... *E21B 7/06* (2013.01); *E21B 34/066* (2013.01); *E21B 44/00* (2013.01); *E21B 47/12* (2013.01);
(Continued)

(58) Field of Classification Search
CPC ..... E21B 34/066; E21B 44/00; E21B 47/024; E21B 47/06; E21B 47/12; E21B 7/06; E21B 10/327; E21B 17/1014; E21B 47/07
See application file for complete search history.

(56) References Cited

U.S. PATENT DOCUMENTS 6,050,346 A 4/2000 Hipp
6,089,332 A 7/2000 Barr et al.
(Continued)

FOREIGN PATENT DOCUMENTS

EP 0530045 A1 3/1993
EP 0540045 A1 5/1993
(Continued)

OTHER PUBLICATIONS

Officer Andre Van Berlo, International Search Report and the Written Opinion, International Patent Application PCT/US2006/016247, Completed Aug. 7, 2006, 15 pp.
(Continued)

*Primary Examiner* — Daniel P Stephenson
(74) *Attorney, Agent, or Firm* — Offit Kurman, P.A.; Gregory A. Grissett

(57) ABSTRACT

A rotary steering tool includes a steering member configured to move between a retracted configuration and an extended configuration. The rotary steering tool also includes a pump configured to pump a fluid, a power source independent of the downhole motor, the power source configured to power the pump, and a piston in fluid communication with the pump. The piston is configured to apply a force to the steering member to move the steering member from the retracted configuration to the extended configuration when the pump pumps the fluid at an operating system pressure. The rotary steering tool includes a controller to operate the pump at a range of operating system pressures, and a variable pressure control valve. The variable pressure control valve adjusts the operating system pressure between the range of operating system pressures to adjust the force applied to the steering member.

35 Claims, 6 Drawing Sheets

(51) Int. Cl.

| | |
|---|---|
| ***E21B 47/12*** | (2012.01) |
| ***E21B 7/06*** | (2006.01) |
| *E21B 47/024* | (2006.01) |
| *E21B 47/06* | (2012.01) |
| *E21B 47/07* | (2012.01) |

(52) U.S. Cl.
CPC ..... *E21B 47/024* (2013.01); *E21B 47/06* (2013.01); *E21B 47/07* (2020.05)

(56) References Cited

U.S. PATENT DOCUMENTS

| | | | | |
|---|---|---|---|---|
| 6,102,681 | A | 8/2000 | Turner | |
| 6,105,690 | A | 8/2000 | Biglin, Jr. et al. | |
| 6,230,823 | B1 | 5/2001 | Sieniawski | |
| 6,257,356 | B1 | 7/2001 | Wassell | |
| 6,328,119 | B1 | 12/2001 | Gillis et al. | |
| 6,392,561 | B1 | 5/2002 | Davies et al. | |
| 6,595,303 | B2 | 7/2003 | Noe et al. | |
| 6,626,254 | B1 | 9/2003 | Krueger et al. | |
| 6,659,200 | B1 | 12/2003 | Eppink | |
| 6,714,138 | B1 | 3/2004 | Turner et al. | |
| 7,327,634 | B2 | 2/2008 | Perry et al. | |
| 7,389,830 | B2 | 6/2008 | Turner et al. | |
| 7,762,356 | B2 | 7/2010 | Turner et al. | |
| 8,157,024 | B2 * | 4/2012 | de Paula Neves | E21B 7/06 175/73 |
| 9,458,679 | B2 * | 10/2016 | Turner | E21B 17/07 |
| 10,337,250 | B2 * | 7/2019 | Turner | E21B 7/10 |
| 2004/0016571 | A1 | 1/2004 | Krueger | |
| 2006/0034154 | A1 | 2/2006 | Perry et al. | |
| 2006/0215491 | A1 | 9/2006 | Hall | |
| 2006/0260843 | A1 | 11/2006 | Cobern | |
| 2020/0392790 | A1 * | 12/2020 | Perry | E21B 17/1014 |

FOREIGN PATENT DOCUMENTS

| | | | | |
|---|---|---|---|---|
| EP | 0770760 | A1 | 5/1997 | |
| EP | 0874128 | A2 | 10/1998 | |
| GB | 2259316 | A | 3/1993 | |
| GB | 2408526 | A | 6/2005 | |
| GB | 2410042 | A | 7/2005 | |
| WO | 0125586 | A1 | 4/2001 | |
| WO | 2006119022 | A2 | 11/2006 | |
| WO | WO-2019013766 | A1 * | 1/2019 | E21B 7/06 |

OTHER PUBLICATIONS

Catalog: Schlumberger PowerDrive Xtra Series, Complete series of rotary steerable systems for reduced well construction cost, Oct. 2002, 7 pp.

Catalog: Schlumberger PowerDrive Xtra 475 Rotary Steerable System, SMP-5897-1, Dec. 2002, 2 pp.

Catalog: Schlumberger Power Drive Vortex, Rotary Steerable System for Supercharged Drilling, Mar. 2000, 5 pp.

Marcus Durant, Slimhole rotary steerable system now a reality, Drilling Contractor, Jul./Aug. 2002, pp. 24-25.

Catalog: Statoil saves big with new rotary steerable system, Drilling Contractor, Mar./Apr. 2004, pp. 44.

* cited by examiner

ROTARY STEERABLE TOOL WITH PROPORTIONAL CONTROL VALVE

TECHNICAL FIELD

The present disclosure relates to a tool, system, and method for controlling the direction of a drill bit, and in particular to a tool, system and related methods for controlling the drill bit with a rotary steerable tool having a proportional control valve.

BACKGROUND

Underground drilling, such as gas, oil, or geothermal drilling, generally involves drilling a bore through a formation deep in the earth. Such bores are formed by connecting a drill bit to long sections of pipe, referred to as a "drill pipe," to form an assembly commonly referred to as a "drill string." Rotation of the drill bit advances the drill string into the earth, thereby forming the bore. Directional drilling refers to drilling systems configured to allow the drilling operator to direct the drill bit in a particular direction to reach a desired target hydrocarbon that is located some distance vertically below the surface location of the drill rig and is also offset some distance horizontally from the surface location of the drill rig. Steerable systems use bent tools located downhole for directional drilling and are designed to direct the drill bit in the direction of the bend. Rotary steerable systems use moveable blades, or arms, that can be directed against the borehole wall as the drill string rotates to cause directional change of the drill bit. Finally, rotatory steerable motor systems also use moveable blades that can be directed against the borehole wall to guide the drill bit. Directional drilling systems have been used to allow drilling operators to access hydrocarbons that were previously unaccessible using conventional drilling techniques.

SUMMARY

There is a need to provide better control of the force that a blade applies to the formation wall during a multiple steering modes. An embodiment of the present disclosure is a rotary steering tool configured to control directional orientation of a drill bit and drill string drilling into an earthen formation. The rotary steering tool includes a steering member configured to move between a retracted configuration and an extended configuration to contact a wall of a borehole in the earthen formation when the drill string is drilling into the earthen formation. The rotary steering tool also includes a pump configured to pump a fluid, a power source independent of the downhole motor, the power source configured to power the pump, and a piston in fluid communication with the pump. The piston is configured to apply a force to the steering member in order to move the steering member from the retracted configuration to the extended configuration when the pump pumps the fluid at an operating system pressure. The rotary steering tool includes a controller configured to operate a variable pressure control valve in fluid communication with the pump. The variable pressure control valve is configured to adjust the operating system pressure between the range of operating system pressures, so as to adjust the force applied to the steering member by the piston.

Another embodiment of the present disclosure is a drilling system for drilling into an earthen formation. The drilling system includes a drill string having an uphole end and a downhole end, a drill bit coupled to the downhole end of the drill string, and a motor configured to power the drill bit. The drilling system also includes a rotary steering tool attached to the drill string uphole from the drill bit. The rotary steering tool includes a steering member configured to contact the earthen formation and a piston for applying a force to the steering member so as to move the steering member moves from a retracted configuration to an extended configuration where the steering member contacts a wall of a borehole of the earthen formation. The rotary steering tool also includes a pump that pumps fluid to the piston, a power source that powers the pump, and a variable pressure control valve configured to adjust an operating system pressure of the fluid pumped by the pump so as to adjust the force applied by the piston to the steering member to move the steering member from the retracted configuration to the extended configuration. A drilling direction of the drill bit changes when the steering member contacts the wall of the borehole of the earthen formation.

A further embodiment of the present disclosure is a method of directing a drill bit coupled to a drill string drilling into an earthen formation during a drilling operation via a rotary steering tool. The method includes pumping fluid through a hydraulic circuit of the rotary steering tool at a first operating system pressure, such that the fluid actuates a piston, and applying a first force to a steering member via the piston, such that the steering member moves between a retracted configuration and a first extended configuration to contact a wall of a borehole in the earthen formation. The method also includes adjusting the operating system pressure of the hydraulic circuit via a variable pressure control valve that is in fluid communication with the hydraulic circuit, such that the variable pressure control valve changes the operating system pressure from a first operating system pressure to a second operating system pressure. The method further includes pumping the fluid through the hydraulic circuit of the rotary steering tool at the second operating system pressure, such that the fluid actuates the piston, and applying a second force to the steering member via the piston, such that the steering member moves between the retracted configuration and a second extended configuration to contact the wall of the borehole in the earthen formation.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
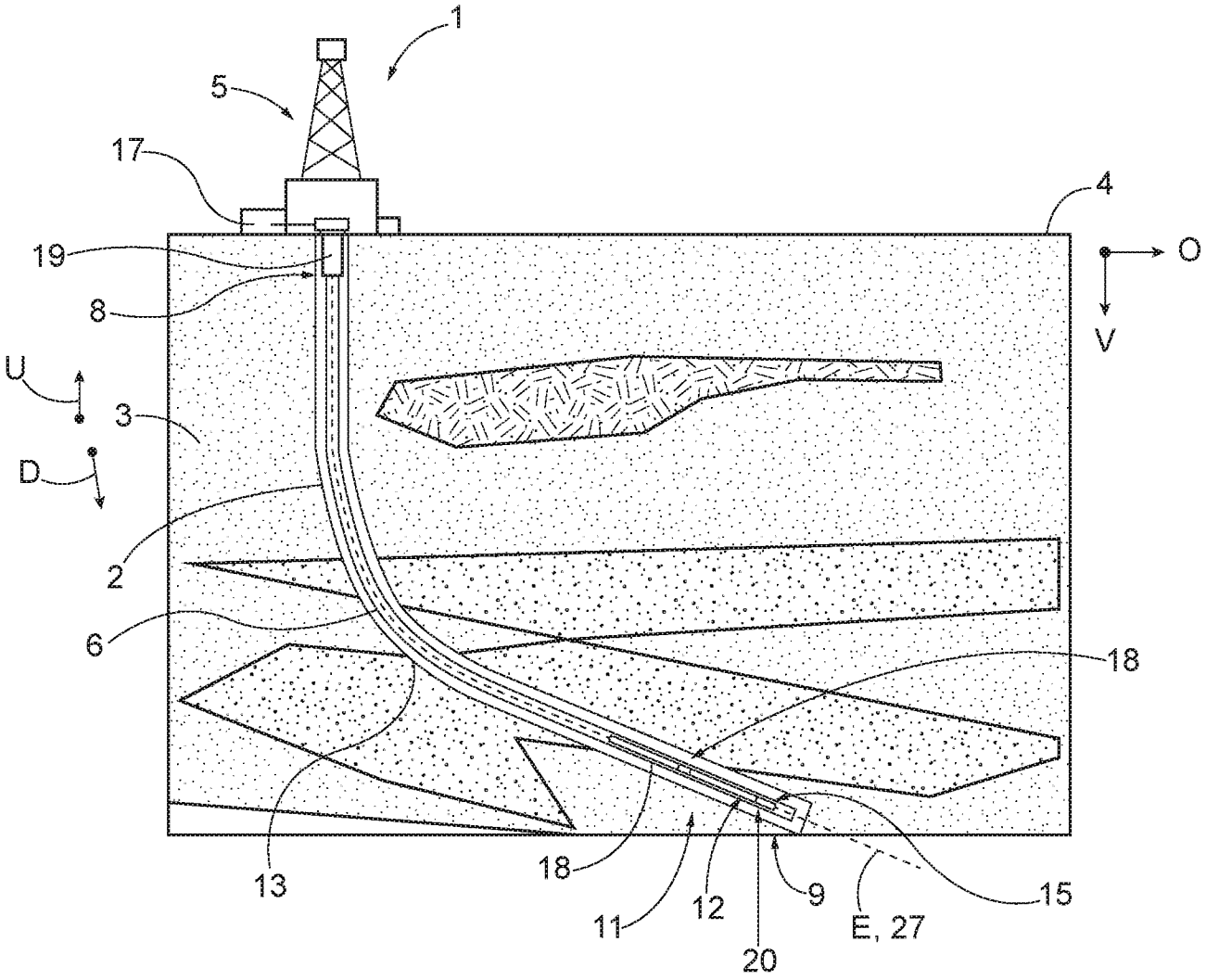
FIG. 1 is a schematic side view of a drilling system according to an embodiment of the present disclosure.
Figure 2:
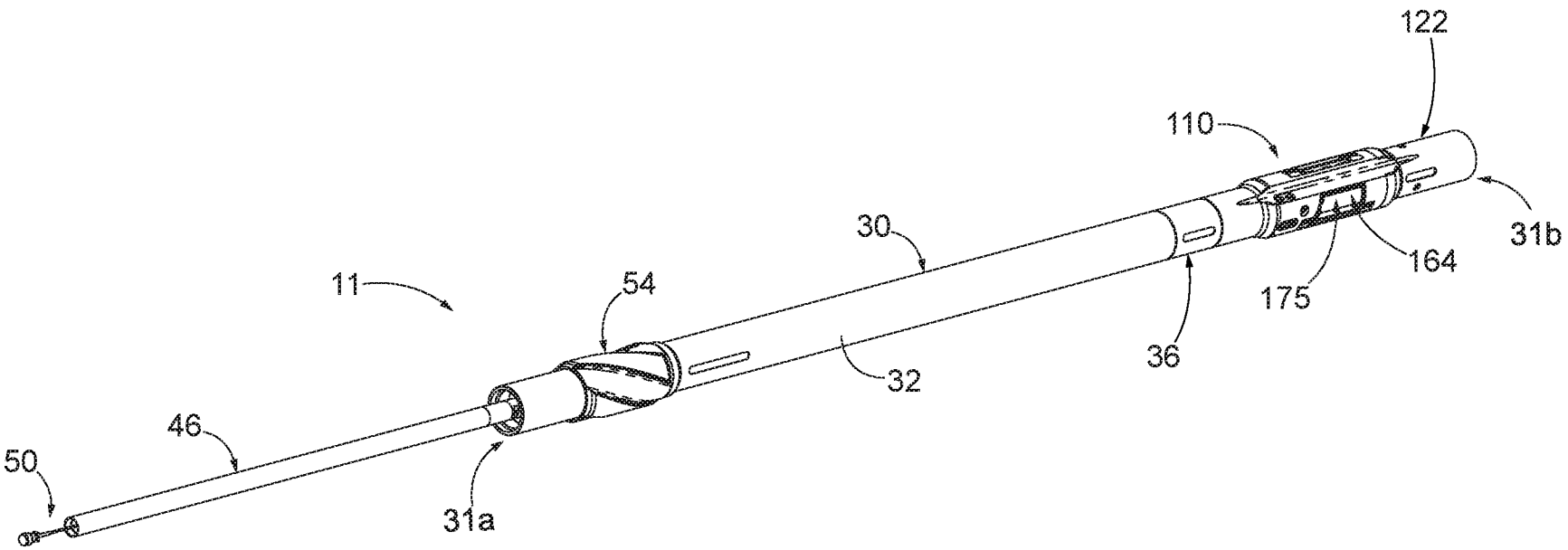
FIG. 2 is a perspective view of a rotary steering tool according to an embodiment of the present disclosure.

As shown in FIGS. 1 and 2, embodiments of the present disclosure include a rotary steering tool 11 used to control direction of a drill bit 15 of a drilling system 1. An exemplary rotary steering tool 11 includes one or more steering members 164 that can move between a retracted configuration and extended configuration to contact the wall of the borehole and thereby adjust the direction of the drilling. In the present disclosure, the rotary steerable tool 11 includes a variable pressure control valve 220 (FIG. 6) that can adjust an operating system pressure of the rotary steerable tool 11 during operation, such as during different steering modes. In particular, the variable pressure control valve 220 may be used to adjust the force applied to the steering member 164 as the steering member transitions into the extended configuration or when the steering member 164 has already transitioned into the extended configuration. The rotary steering tool 11 will be described further below.

Referring to FIG. 1, the drilling system 1 includes a rig or derrick 5 that supports a drill string 6. The drill string 6 is elongate along a longitudinal central axis 27 that is aligned with a well axis E. The drill string 6 further includes an uphole end 8 and a downhole end 9 spaced from the uphole end 8 along the longitudinal central axis 27. A downhole or downstream direction D refers to a direction from the surface 4 toward the downhole end 9 of the drill string 6. An uphole or upstream direction U is opposite to the downhole direction D. Thus, "downhole" and "downstream" refers to a location that is closer to the drill string downhole end 9 than the surface 4, relative to a point of reference. "Uphole" and "upstream" refers to a location that is closer to the surface 4 than the drill string downstream end 9, relative to a point of reference.

Continuing with FIG. 1, the drill string 6 includes a bottomhole assembly (BHA) 10 coupled to a drill bit 15. The drill bit 15 is configured to drill a borehole or well 2 into the earthen formation 3 along a vertical direction V and an offset direction O that is offset from or deviated from the vertical direction V. The drilling system 1 can include a surface motor (not shown) located at the surface 4 that applies torque to the drill string 6 via a rotary table or top drive (not shown), and a downhole motor 18 disposed along the drill string 6 that is operably coupled to the drill bit 15 for powering the drill bit 15. Operation of the downhole motor 18 causes the drill bit 15 to rotate along with or without rotation of the drill string 6. In this manner, the drilling system 1 is configured to operate in a rotary drilling mode, where the drill string 6 and the drill bit 15 rotate, or a sliding mode where the drill string 6 does not rotate but the drill bit does rotate. Accordingly, both the surface motor and the downhole motor 18 can operate during the drilling operation to define the well 2. The drilling system 1 can also include a casing 19 that extends from the surface 4 and into the well 2. The casing 19 can be used to stabilize the formation near the surface. One or more blowout preventers can be disposed at the surface 4 at or near the casing 19. During the drilling operation, in a drilling operation, the drill bit 15 drills a borehole into the earthen formation 3. A pump 17 pumps drilling fluid downhole through an internal passage (not shown) of the drill string 6 out of the drill bit 15. The drilling fluid then flows upward to the surface through the annular passage 13 between the bore hole and the drill string 6, where, after cleaning, it is recirculated back down the drill string 6 by the mud pump.

As shown in FIG. 1, embodiments of the present disclosure may include a plurality of sensors 20 located along the drill string 6 for sensing a variety of characteristics related to the drilling operation. The sensors 20 can include accelerometers, magnetometers, strain gauges, temperature sensors, pressure sensors, or any other type of sensor as conventionally used in a drilling operation to measure such aspects as tool inclination, tool face angle, azimuth, temperature, pressure, drill string rotational speed, mud motor speed, drill bit acceleration, drill bit temperature, and/or drill string RPM.

Figure 3:
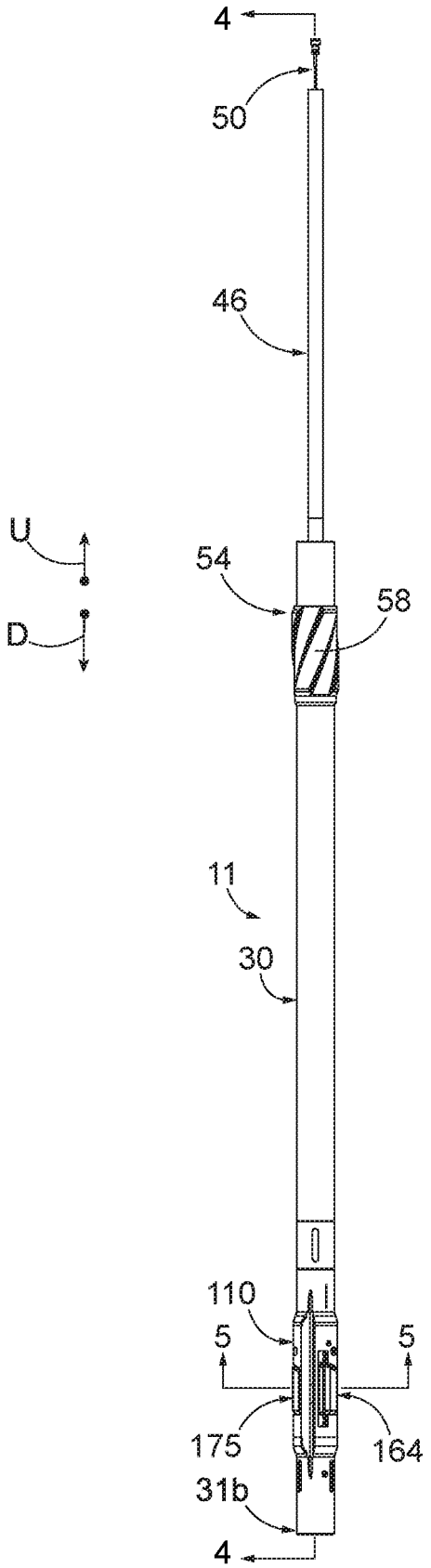
FIG. 3 is a side view of the rotary steering tool shown in FIG. 2.
Figure 4:
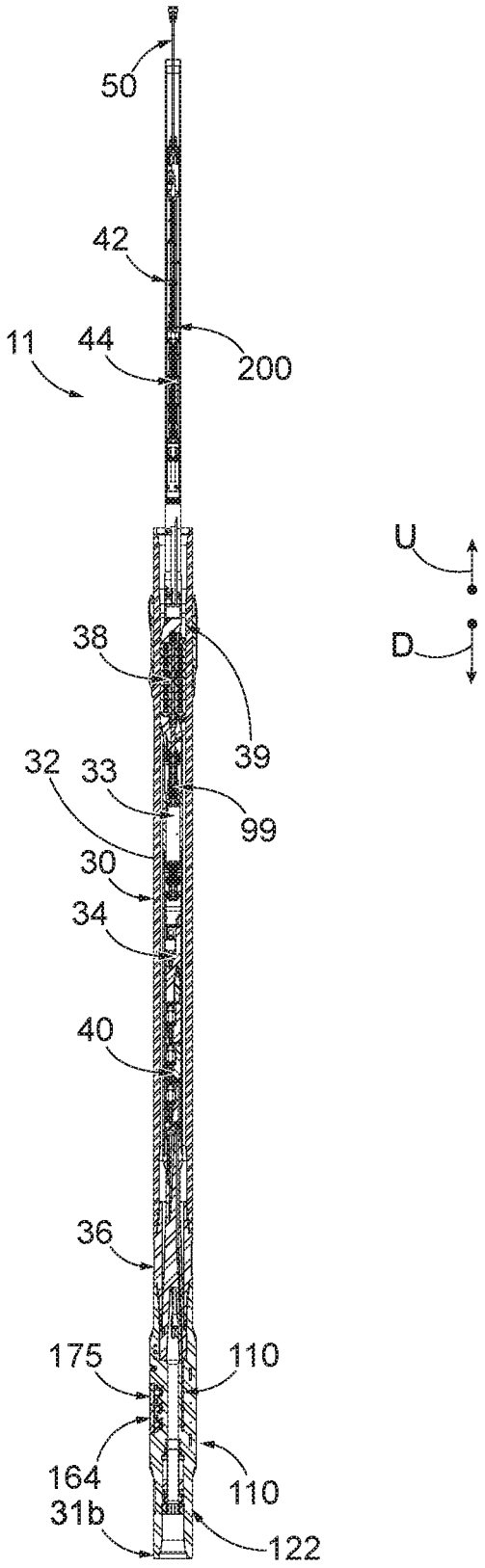
FIG. 4 is a cross-sectional view of the rotary steering tool taken along line 4-4 in FIG. 3.

Continuing with FIGS. 2-4, the rotary steering tool 11 may form a portion of the bottom hole assembly 10. The rotary steering tool 11 includes a housing assembly 30 that carries the components of the rotary steering tool 11. The housing assembly 30 has an uphole end 31*a*, a downhole end 31*b* opposite the uphole end 31*a*, and an internal passage (not numbered) that extends along the entire length of the housing assembly 30. The internal passage allows drilling fluid to pass through the rotary steering tool toward the drill bit 15. The housing assembly 30 may be comprise of multiple housing components or subs connected together end-to-end. For instance, the housing assembly 30 includes a tool housing 32, an adapter housing 36, and steering module housing 122. The adapter housing 36 couples the tool housing 32 to the steering module housing 122. The housings that form the housing assembly 30 include standard threaded connections used in oil & gas drilling systems. For example, each opposed ends, of each housing, may be configured as a pin connection and/or a box connection. As illustrated, the tool housing 32 includes opposed box connections, the adapter housing 36 includes opposed pin connections, and the steering module housing 122 includes opposed box connections. However, the connection types may differ from what is explicitly shown in the drawings. In any event, the threaded connections at the uphole end 31*a* and the downhole end 31*b* connect the housing assembly 30 to the drill string tubulars or other subs in the drill collar of the drill string 6 so that the housing assembly 30 rotates as the drill string 6 rotates. In the depicted embodiment, the housing assembly 30 forms part of a drill collar of the drill string 6.

The rotary steering tool 11 can also include a stabilizer 54 to help center the tool 11 in the borehole during drilling. The stabilizer 54 can be attached to the exterior of the housing assembly 30 through various means, such as a threaded connection, so that the stabilizer 54 rotates with the housing assembly 30. The stabilizer 54 includes a plurality of stabilizer blades 58 that project outwardly from the tool 11. In one embodiment the stabilizer 54 can include three stabilizer blades 58. However, in alternative embodiments, any number of stabilizer blades 58 may be used. Each stabilizer blade 58 can be arranged in a linear or helical pattern. In any event, however, the stabilizer blades 58 project outwardly a height selected so that the maximum diameter of the stabilizer 54 is slightly smaller than the diameter of the borehole 2. Contact between the stabilizer blades of the stabilizer 54 and the borehole wall helps to center the rotary steering tool 11, and the drill string 6 as a whole, within the borehole 2.

Referring to FIGS. 2-4, the rotary steerable tool 11 includes a pump 34, a power system (not numbered), a manifold assembly 40, an electronics assembly 42, and a rotary steering module 110.

Figure 6:
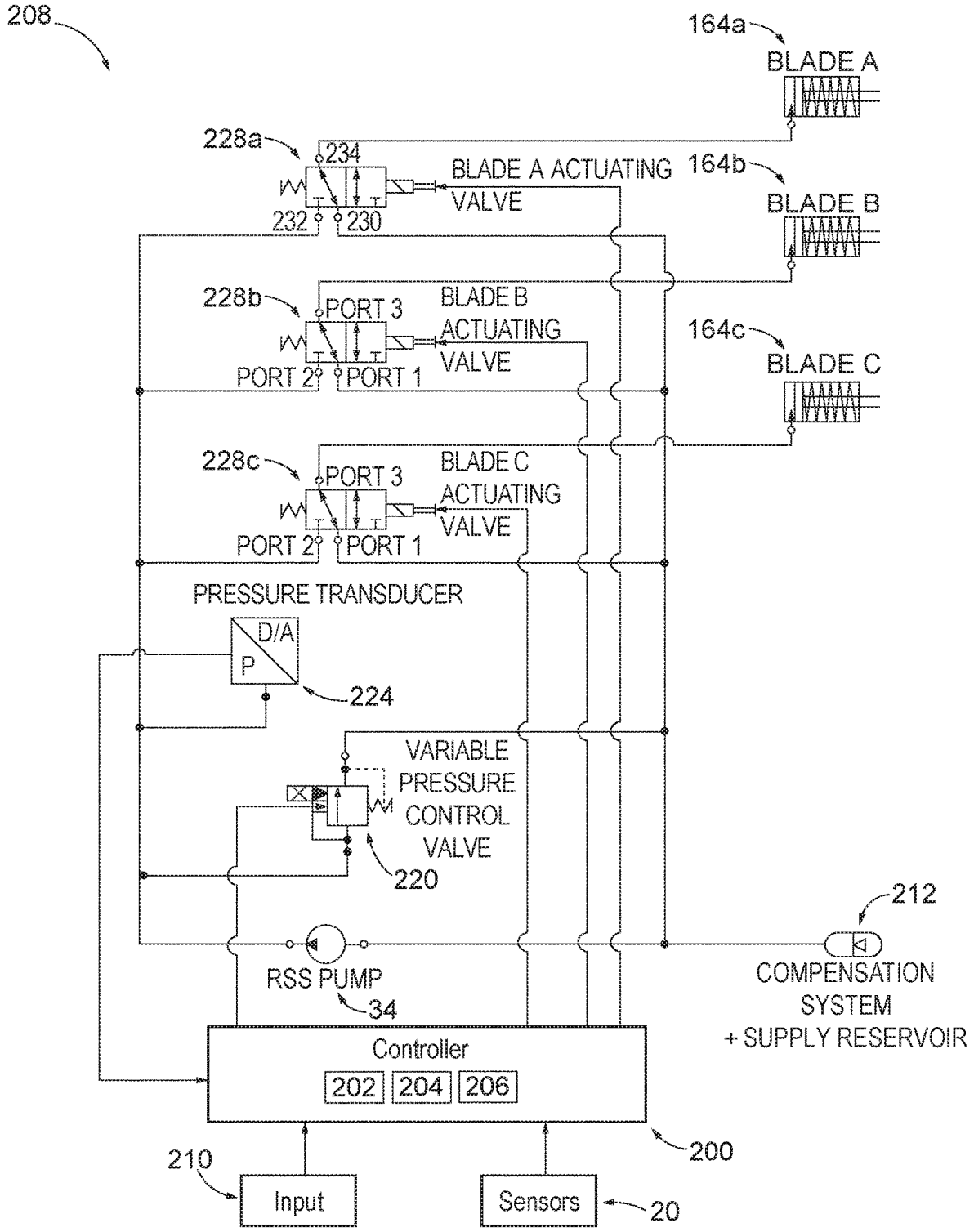
FIG. 6 is a schematic block diagram of various components of the rotary steering tool shown in FIG. 2.

The pump 34 is coupled to the power system. In the example shown, the pump 34 can be a hydraulic vane pump that includes a stator and a rotor disposed concentrically within the stator (not shown). Other types of pumps, such as gear pumps can be also be used. A drive shaft 99 (FIG. 4) transfers power from a turbine 38 to the pump 34 and to an alternator 33. The rotor of the pump 34 can be rotated in relation to the stator by the turbine 38 (FIG. 4). This rotation pumps fluid, which can be oil, through a hydraulic circuit 208 at an operating system pressure. The hydraulic circuit 208 is described throughout this disclosure and is shown in FIG. 6. The operating system pressure can be regulated by the variable pressure control valve 220, as will be discussed further below.

Referring to FIG. 4, the power system operably coupled to the electronics assembly 42 within the rotary steering tool 11. In the illustrated embodiment, the power system includes the turbine 38 and the alternator 33 operably coupled to the turbine 38. The turbine 38 is also shown disposed within an internal bore 39 defined by the housing assembly 30. The alternator 33 is contained within a compensated pressure housing that can be filled with oil to lubricate the alternator 33, the oil being pressure compensated to the drilling fluid. The flow of drilling fluid through the internal bore 39 drives the turbine, which drives a shaft 99 coupled to the alternator 33. Rotation of turbine therefore drives the alternator 33. The alternator 33, in turn, generates electrical power for the electronics assembly 42. The alternator 33 may also be referred to as a generator in this disclosure. In one example, the alternator 33 can be a three-phase alternator 33 that can tolerate the temperatures, pressures, and vibrations typically encountered in a downhole drilling environment. However, any suitable generator may be used. It should be noted here that power system, e.g. the turbine 38 and alternator 33, supplies power to the electronics assembly 42 that is independent from any other power sources of the drill string 6.

Continuing with FIGS. 4 and 6, a hydraulic manifold assembly 40 is also included in the rotary steering tool 11 positioned between the rotary steering module 110 and the pump 34. The hydraulic manifold assembly 40 includes a plurality of valves 228*a*, 228*b* and 228*c*. (valves schematically shown in FIG. 6), a compensation system 212, and a pressure transducer 224. The valves 228*a*, 228*b* and 228*c* are substantially similar and reference numbers 228*a*, 228*b* and 228*c* are used interchangeably with reference number 228 for ease of illustration. The manifold assembly 40 can define a plurality of passages (not numbered) that are in communication with the plurality of valves 228, respectively.

Figure 5:
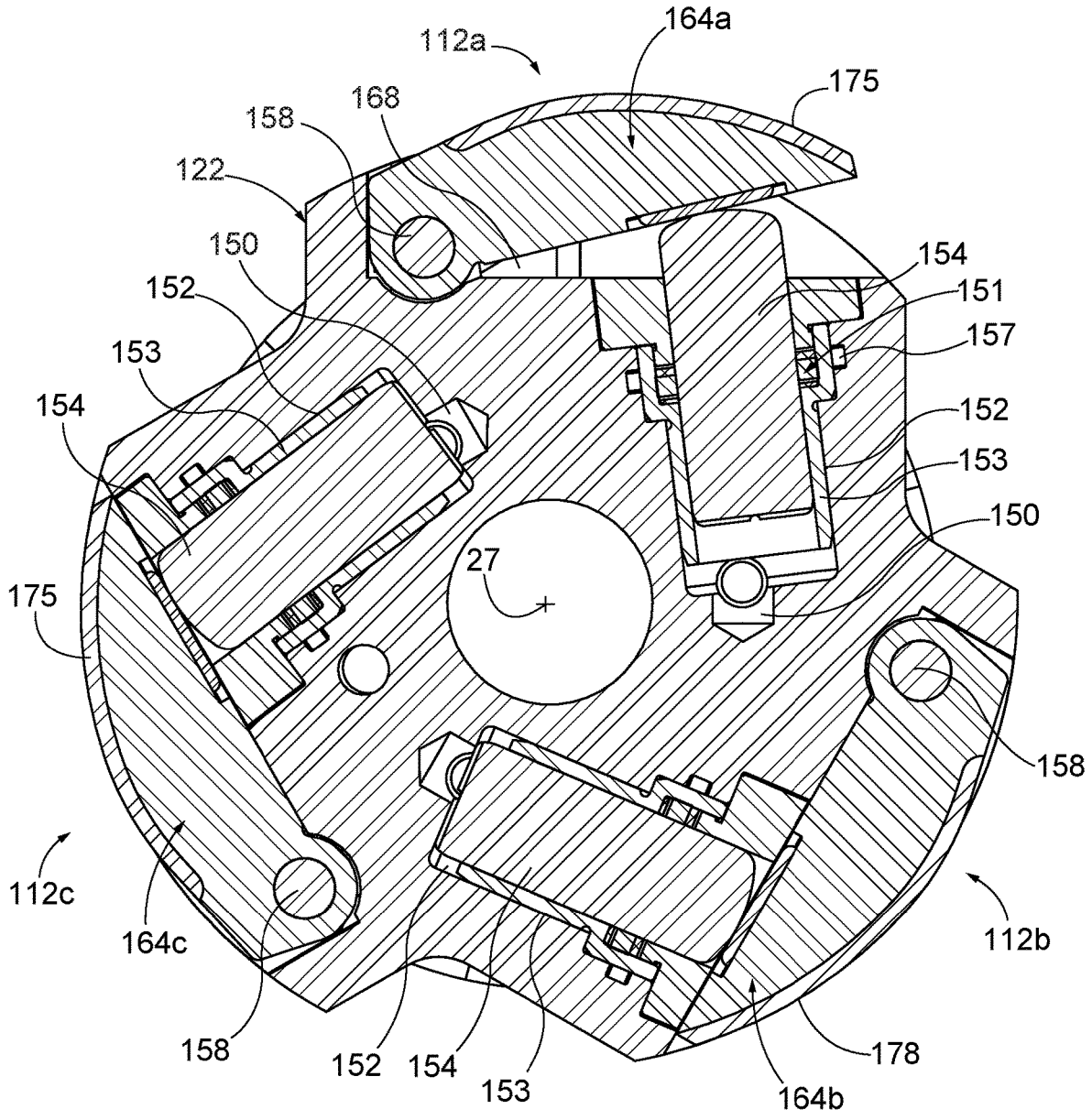
FIG. 5 is a cross-sectional view of the rotary steering module of the rotary steering tool shown in FIG. 3 taken along line 5-5.

The valves 228 control the flow of hydraulic fluid within the hydraulic circuit 208 of the rotary steerable tool 11. Each valve 228 has a number of ports and a mechanism to selectively open and close various combinations of the ports, as further discussed below. More specifically, the valve 228 has a first port 230 in communication with both the inlet of the pump 34 and a hydraulic fluid supply 212. The first port 230 is therefore exposed to a fluid at a pressure approximately equal to the inlet pressure of the pump 34. As the hydraulic fluid supply 212 is integral to the compensation system 212, the hydraulic system is therefore compensated to the pressure of the drilling fluid. The valve 228 also includes a second port 232 directly open to the outlet of the pump 34. The second port 232 is exposed to fluid at a pressure approximately equal to an operating pressure controlled by a variable pressure control valve 220 (FIG. 5). In addition, the valve 228 has a third port 234 that is open to a hydraulic passage connected to the piston. The third port 234 is therefore in fluid communication with the piston. In the illustrated example, each valve 228*a*, 228*b* and 228*c* includes a first port 230, a second port 232, and a third port 234. The illustrated valves 228*a*-228*c* may be solenoid valves, which are configured to transition from one configuration into another configuration to control flow therethrough, in response to controller activation. Other types of valves may be used. For instance, the valves may be rotary valves.

The compensation system 212 is configured to maintain a pressure approximately equal to the downhole hydrostatic pressure. The compensation system 212 also acts as a hydraulic fluid supply.

The pressure transducer 224 is positioned and configured to measure the hydraulic pressure generated by the pump 34 and maintained by the pressure control valve 220. The pressure transducer 224 is in communication with the controller 200, such that the controller 200 can monitor the actual pressure within the hydraulic circuit 208 and make changes accordingly, as will be discussed below.

The electronics assembly 42 may be located at the uphole end 31*a* of the tool 11. The electronics assembly 42 is placed within a pressure housing 46 that protects various components of the electronics assembly 42. The electronics assembly 42 may include a voltage regulator board 44, connector 50, and the controller 200. The voltage regulator board 44 includes a rectifier and a voltage regulator. The rectifier receives the alternating current (AC) output from the alternator 33 and converts the AC output to a direct current (DC) voltage. The voltage regulator regulates the DC voltage to a level appropriate for the controller 200, as well as the other components of the electronics assembly 42 powered by the alternator 33.

The controller 200 is configured to control the operation of the rotary steering tool 11. The controller 200 includes a processor 202, a memory unit 204 for storing information related to the components and operation of the rotary steering tool 11, and a communications module 206 for electronic connection other components of the tool and sensors in the drilling string. In some embodiments, the controller 200 can be configured to autonomously operate various aspects of the rotary steering tool 11. However, the controller 200 can also receive instructions via the connector 50. In some cases, the connector 50 may plug into a power source or some other part of the MWD system, which is, in turn, connected directly to a pulser. In other words, the controller 200 may be directly or indirectly connected to communications devices so as to receive instructions. In certain embodiments, the instructions may be transmitted from other components of the bottom hole assembly 10 and/or command instructions from the surface system. For instance, a signal can be produced uphole by an operator of the drilling system 1 located at the surface 4 of the earthen formation 3 and subsequently transmitted downhole through various conventional downhole communication means, including but not limited to, typical downlinking mechanisms, Intellipipe, downlinking pressure pulses, modulation of rotational speed of the drill string, mud flow rate modulation or electromagnetic (EM) telemetry. Regardless of what mechanism is used to transmit the signal downhole, the signal can be indicative of an input 210 made by the operator of the drilling system 1 that controls subsequent operation of the rotary steering tool 11, particularly the rotary steering module 110. The controller 200 can communicate the input 210 and other instructions throughout the rotary steering tool 11 to other components of the rotary steering tool 11 through wiring (not shown) disposed within the rotary steering tool 11.

Continuing with FIGS. 2-5, the rotary steering tool 11 includes a steering module 110 that includes the steering module housing 122. The steering module 110 also includes a plurality of steering members 164*a*, 164*b*, and 164*c* configured to extend and retract from the housing 122 on a selective basis, and a plurality of actuation assemblies 112*a*, 112*b*, and 112*c* that operate to move the steering members 164*a*-164*c* between the retracted and extended configurations. Each steering member 164*a*, 164*b* and 164*c* are similar and reference numbers 164*a*, 164*b*, and 164*c* may be used interchangeably with reference number 164. Likewise, each actuation assembly 112*a*, 112*b* and 112*c* are similar and reference numbers 112*a*, 112*b*, and 112*c* may be used interchangeably with reference number 112. An embodiment with three steering members 164 and related actuation assemblies 112 is depicted and described below for simplicity. However, any number of steering members 164 and actuation assemblies can be included. As shown in FIG. 5, the actuation assemblies 112*a*-112*c* are spaced at intervals of approximately 120 degrees about the central axis 27. However, when more or less actuation assemblies are included, the spacing may vary.

The steering module housing 122 can define three deep-drilled holes 150 that form part of the hydraulic circuit 208. Each hole 150 is also in fluid communication with an outlet of a respective valve 228 of the hydraulic manifold assembly 40. The holes 150 each extend downhole in a direction substantially parallel to the central axis 27 to a position substantially proximate a respective one of the steering members 164. Each valve 228 of the hydraulic manifold assembly 40 is configured to selectively route the relatively high-pressure fluid from the discharge of the pump 34, as controlled by the variable pressure control valve 220, to an associated hole 150, in response to the commands form the controller 200.

Each actuation assembly 112 includes at least one cylindrical bore 152 and at least one piston 154 positioned within the cylindrical bore 152. Each cylindrical bore 152 is located beneath a respective steering member 164. The cylindrical bore 152 may be defined by a replaceable sleeve 153. The sleeve 153 is used to facilitate repair as repeated translation of the piston wears inner surface of the bore over time. The sleeve, therefore, can be replaced without having to replace the entire module. In certain embodiments, there may be two or three cylinders and two or three associated pistons. However, more or less number of cylinders and pistons may be used. Each deep hole 150 discussed above is also in fluid communication with the cylindrical bore 152.

Each piston 154 is movable with the cylinder 152 to contact to underside the steering member 164, or pad. As illustrated, the diameter of each piston 154 is sized so that the piston 154 can translate in a direction substantially coincident with the central (longitudinal) axis of its associated cylindrical bore 152. An end of each piston 154 is exposed to the fluid in its associated cylindrical bore 152, while the opposite end of the piston 154 contacts the underside of an associated steering member 164. As a result, each of the pistons 154 is in fluid communication with the pump 34 and the variable pressure control valve. A static seal 157 and a dynamic seal 151 are mounted on the housing 122 and sleeve 153 to create a sealed interface between the cylindrical bore 152 and the associate piston 154, and thereby contain the high-pressure fluid in the cylindrical bore 152. The fluid in the hydraulic circuit 208 is configured to selectively impose force on the steering members 164, forcing the steering members 164 from a retracted configuration to an extended configuration.

Each of the steering members 164 is shown pivotally coupled to the housing 122 by a pin 158 so that the steering members 164 can pivot between the retracted configuration to the extended configuration. Ends of the pins 158 are received in bores formed in a block or clamp. However, the bores may be directly formed in the housing 122, and are retained by a suitable means, such as clamps. However, it should be appreciated that the steering member could be moveably coupled for translation as opposed to rotational movement. In FIG. 5, steering member 164*a* is shown in the extended configuration.

Continuing with FIG. 5, each of the steering members 164 can further define a contact surface 175 that faces borehole 2 exterior to the rotary steering tool 11. When in the extended configuration, the steering members 164 can each contact a wall of the borehole 2 to push the drill bit 15 in a desired direction. Recesses 168 are formed in the housing 122, and are each configured to accommodate an associated steering member 164, such that the contact surface 175 of each steering member 164 is nearly flush with the adjacent surface of the housing 122 when the steering member 164 is in the retracted configuration. Each steering member 164 can be biased towards the retracted configuration using a torsional spring (not shown) disposed around the corresponding pin 158 to facilitate ease of handling as the system is lowered into and raised from the borehole 2.

In operation, the valves 228 transition between a deenergized configuration, which permits the steering member 164 to retract, into an energized configuration, which causes the steering members 164 to extend outwardly. In the deenergized configuration, the first port 230 and third port 234 are in communication with each other, with the second port 232 closed. In this way, fluid can flow from the cylindrical bore 152 adjacent the piston into the hydraulic supply. When the controller state changes, the valves are energized. In the energized configuration, therefore, the second port 232 and the third port 234 are connected and in flow communication with each other while the first port 230 is closed. This allows oil from the outlet of the pump to flow to the cylindrical bore 152 toward the piston 154. This causes the pistons 154 to move outwardly and likewise act against the steering member 164. The steering member 164 is thus moved outward from the retracted configuration to the extended configuration, and the contact surface 175 of the steering member 164 applies a force to the wall of the borehole 2. The surface of the borehole 2 exerts a reactive force on the steering member 164 in substantially the opposite direction. This reactive force urges the drill bit 15 in a direction that substantially aligns with the reactive force. At a desired time, when the solenoid of the valve 228 is deenergized, the piston 154 travels back into the bore and the fluid is displaced back into the compensation system/supply reservoir 212.

The steering members 164 are shown as blades that can pivot between the retracted and extended configurations. However, the steering members can have other configurations. For instance, the steering members 164 may be moveable pads that translate between the retracted and extended configurations. In another example, the steering members 164 may be piston extensions that are directly or indirectly coupled to the pistons 154. Accordingly, the steering member 164 broadly encompass a variety of different shapes and configurations.

Continuing with FIG. 6, a hydraulic control circuit 208 for the rotary steerable tool 11 is schematically shown. The hydraulic control circuit 208 includes the controller 200, a variable pressure control valve 220, a pressure transducer 224, and a plurality of valves 228*a*, 228*b*, 228*c* that are associated with corresponding steering member 164*a*, 164*b*, 164*c*, respectively. In this manner, the valves 228*a*-228*c* is configured to selectively provide pressurized fluid to the piston 154 associated with the steering member 164*a*-164*c* in order to transition a particular steering member 164*a*-164*c* from the retracted configuration to the extended configuration, as explained above. The hydraulic control circuit 208 may further include the pump 24 and the compensation system 212. Furthermore, the controller can be configured to operate the plurality valves sequentially or in any order deemed fitting to achieve the desired effect of actuating the steering members 164.

The valves 228*a*-228*c* are in electronic communication with the controller 200, which directs the operation of the valves at a specific desired time. Further, each of the valves 228 are in fluid communication with the variable pressure control valve 220, which is configured to control and adjust the operating system pressure of the hydraulic circuit 208 at any particular time. The range of potential operating system pressures is defined by a minimum system pressure and a maximum system pressure. In one example, the minimum system pressure can be about 100 psi and the maximum system pressure can be about 3000 psi. However, other minimum and maximum system pressures are contemplated. By varying the operating system pressure within the hydraulic circuit 208, the pressure the fluid imposes on each piston 154 is varied, which likewise varies the force each piston 154 applies to its corresponding steering member 164.

The variable pressure control valve 220 is in fluid communication with the pump 34 and in electronic communication with the controller 200. The controller 200 can instruct the variable pressure control valve 220 to adjust the operating system pressure between a range of operating system pressures so as to adjust the force applied to the steering members 164 by the pistons 154. In use, this is performed by varying a current supplied to the variable pressure control valve 220 by a circuit within the controller, indirectly from the alternator 33. Alternatively, a circuit within the controller may be configured to vary the voltage supplied to the variable pressure control valve 220. The controller 200 can instruct the variable pressure control valve 220 to adjust the operating pressure of the hydraulic circuit 208 for a variety of reasons. The controller 200 can recall intended operating system pressures from its memory unit at particular points in time that correspond to a predetermined well plan and subsequently instruct the variable pressure control valve 220 to implement those pressures. Alternatively, the controller 200 can receive a data input 210 from a system located at the surface 4 of the earthen formation 3. This input I can be transmitted from the surface system via a downlink signal using one of the aforementioned downhole communications systems, e.g. flowrate and drill string rotation speed modulation. Likewise, the same telemetry tool can transmit an uplink signal from the controller 200 to the surface system that is indicative of a downhole characteristic of the drilling system 1, such as the operating system pressure of the hydraulic circuit 208.

The controller 200 can further direct the variable pressure control valve 220 to adjust the operating system pressure of the hydraulic circuit 208 in response to a feedback signal received from the pressure transducer 224. As noted above, the pressure transducer 224 is in fluid communication with the hydraulic circuit 208, and functions to continuously monitor the actual pressure of the fluid in the hydraulic circuit 208. This information is communicated to the controller 200, which compares the actual pressure detected by the pressure transducer 224 to the predetermined operating system pressure. If there is a discrepancy between the two, the controller 200 can direct the variable pressure control valve 220 to adjust the operating system pressure by altering the current (or voltage) to the variable pressure control valve 220. Additionally, the controller 200 can direct the variable pressure control valve 220 to change the operating system pressure in response to an input received from one or more of the sensors 20. It should be appreciated that system pressure may be constant as dictated by the variable pressure control valve 220, e.g. pressure is set to 1000 psi. Whenever the system is running, the duration that the hydraulic fluid is acting on the piston may be adjusted to provide more time to push the bit, via activation of the piston 154 against the steering member 164, as discussed above. In this regard, it is possible to change system pressure as needed. This, in turn, allows the amount of force applied to the borehole wall by the steering member to be controlled more directly. The result is less wear and tear and lower pressure on seals because the system utilizes a shorter duration of higher force application to cause directional changes of the bit.

The use of the variable control valve improves operational efficiency of the RSS tool compared to conventional rotary steerable tools. For instance, conventional rotary steerable systems have hydraulic circuits that are used to control movement of the pistons, which force pads against the borehole wall for a particular duration. These hydraulic circuits deliver pressurized fluid, typically oil, to the blades to provide a reaction force when the blade contacts the formation wall. In such conventional rotary steerable systems, the hydraulic circuits have limited means to adjust pressure, and therefore also have limited means to adjust the force the blade applies to the formation wall. For example, the hydraulic circuit can therefore cause the blade to apply excessive force against the formation wall. This, in turn, may cause excessive wear and tear on the blades and possibly on other components of the tool. This limitation in conventional RRS systems is primarily due to the presence a pressure relief valve that has a single maximum set pressure. In the present disclosure, the variable control valve allows the rotary steerable tool to operate at a range of operating pressures and enhance control of the tool during use.

Figure 7:
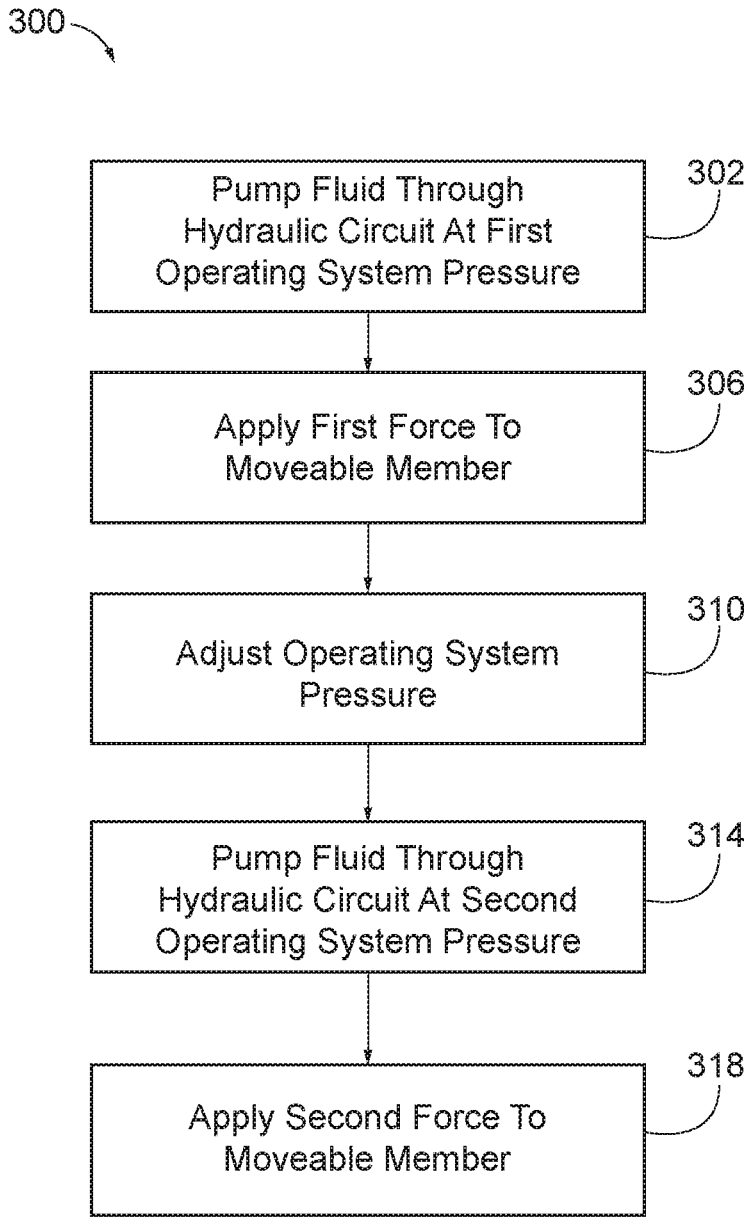
FIG. 7 is a process flow diagram illustrating a method for adjusting the operating system pressure of the hydraulic circuit according to an embodiment of the present disclosure.

Now referring to FIG. 7, a method 300 for adjusting the operating system pressure of the hydraulic circuit 208 will be described. First, in step 302 the pump 34 pumps the fluid through the hydraulic circuit 208 at a first operating system pressure. This first operating system pressure is selected by the controller 200 based upon the input 210, a reading from the sensors 20, a drilling plan stored in the memory unit of the controller 200, or any combination thereof. Then, in step 306 one of the valves 228 is energized, thus allowing the pressurized fluid within the hydraulic circuit 208 to flow through the valve 228 and act upon the corresponding piston 154. Likewise, the piston 154 applies a first force to the corresponding steering member 164, such that the steering member 164 moves between the retracted configuration and a first extended configuration to contact the wall of the borehole 2 in the earthen formation 3. In the first extended configuration, the steering member 164 applies a first force to the wall of the borehole 2.

After step 306, in step 310 the controller 200 directs the variable pressure control valve 220 to adjust the operating system pressure of the hydraulic circuit 208 from the first operating system pressure to a second operating system pressure that is different than the first operating system pressure, if needed. This step can be performed autonomously by the controller 200 in response to a specific impetus, such as a difference between the actual pressure of the fluid and the first operating system pressure as sensed by the pressure transducer 224 or a downhole characteristic of the drilling operation as detected by one of the sensors 20.

Further, step 310 can also involve transmitting an uplink signal from the controller 200 to the surface system using any of the aforementioned downhole communication methods, where the uplink signal is indicative of the operating system pressure or one or more of the downhole characteristics.

Continuing with step 314, the pump 34 pumps the fluid through the hydraulic circuit 208 at the second operating system pressure. Then, in step 318 one of the valves 228 is energized, thus allowing the pressurized fluid within the hydraulic circuit 208 to flow through the valve 228 and act upon the corresponding piston 154. Likewise, the piston 154 applies a force to the corresponding steering member 164, such that the steering member 164 moves between the retracted configuration and a second extended configuration to contact the wall of the borehole 2 in the earthen formation 3. Because the second operating system pressure is different than the first operating system pressure, the second force is different than the first force. In the second extended configuration, the steering member 164 applies a second force to the wall of the borehole 2. The application of the second force to the wall of the borehole 2 alters the direction of the drill bit 15. When the steering member 164 is in the first extended configuration and applies the first force to the wall of the borehole 2, the drill bit 15 has a first build rate. However, when the steering member 164 is in the second extended configuration and applies the second force to the wall of the borehole 2, the drill bit 15 has a second build rate that is different than the first build rate.

As noted above, it is possible to set system operating pressure during operation of the RSS tool. In the present disclosure, drilling direction changes are caused by activation of the pistons 154, which in turn contact the blades 164. Activation of the pistons 154 is controlled by the variable pressure control valve 220 and operation of the solenoid valves 228 as noted above. The RSS tool 11 in the present disclosure permits optimization of steering performance by being able to adjust duration of blade activation and varying pressure applied to the blades during drilling. For instance, to increase the build-up rate (BUR), the system can cause an increase in current (or voltage) supplied to the solenoid of the variable pressure control valve 220. To decrease the BUR, the system can cause a decrease in current (or voltage) supplied to the solenoid of the variable pressure control valve 220. It is also possible to adjust BUR by changing the duration of time that the solenoid valve 228 is activated. In practice, this permits more precise control of duration of blade extension and of the pressure during blade extension, which, in turns, permits greater optimization of BUR adjustment during drilling. Furthermore, the ability to control pressure (via controller and the variable pressure control valve) and duration of blade extension permits optimization of tool performance, e.g. by optimizing steering forces applied to the borehole wall.

The present disclosure is described herein using a limited number of embodiments, these specific embodiments are not intended to limit the scope of the disclosure as otherwise described and claimed herein. Modification and variations from the described embodiments exist. More specifically, the following examples are given as a specific illustration of embodiments of the claimed disclosure. It should be understood that the invention is not limited to the specific details set forth in the examples.

What is claimed:

1. A rotary steering tool configured to control directional orientation of a drill bit along a drill string drilling into an earthen formation, the rotary steering tool comprising:

a steering member configured to move between a retracted configuration and an extended configuration to contact a wall of a borehole in the earthen formation;

a pump configured to pump a fluid;

a power source independent of the downhole motor, the power source configured to power the pump;

a piston in fluid communication with the pump, the piston being configured to apply a force to the steering member in order to move the steering member from the retracted configuration into the extended configuration when the pump pumps the fluid at an operating system pressure;

a variable pressure control valve in fluid communication with the pump; and a controller configured to operate the variable pressure control valve at a range of operating system pressures, wherein the range of operating system pressures includes a minimum system pressure and a maximum system pressure, wherein the variable pressure control valve is configured to adjust the operating system pressure between the range of operating system pressures so as to adjust the force applied to the steering member by the piston.

2. The rotary steering tool of claim 1, wherein the controller is configured to, in response to one or more inputs to the controller, cause the variable pressure control valve to adjust to a predetermined operating system pressure.

3. The rotary steering tool of claim 2, wherein the one or more inputs includes tool inclination, tool face angle, azimuth, temperature, pressure, drill string rotational speed, pump speed, mud motor speed, or an operator input.

4. The rotary steering tool of claim 2, further comprising a pressure transducer that is configured to detect an actual pressure of the hydraulic fluid.

5. The rotary steering tool of claim 4, wherein the controller is configured to 1) compare the actual pressure to a predetermined pressure of the fluid, and 2) cause the variable pressure control valve to adjust the operating system pressure when the actual pressure differs from the predetermined pressure.

6. The rotary steering tool of claim 1, wherein the controller is configured to vary a power input to the variable pressure control valve to adjust the operating system pressure.

7. The rotary steering tool of claim 1, wherein the controller is configured to supply a current to the variable pressure control valve, wherein the power source is configured to cause the variable pressure control valve to adjust the operating system pressure by varying the current.

8. The rotary steering tool of claim 1, wherein the steering member is one of a plurality of steering members and the piston is one of a plurality of pistons, wherein each of the plurality of pistons is configured to apply a force to a respective one of the plurality of steering members.

9. The rotary steering tool of claim 1, further comprising a plurality of solenoid valves associated with each one of the plurality of steering members, wherein the controller is configured to operate the plurality of solenoid valves, such that activation of the solenoid valves causes activation of the respective one of the plurality of steering members.

10. The rotary steering tool of claim 9, wherein the controller is configured to operate the plurality of solenoid valves sequentially.

11. The rotary steering tool of claim 9, wherein the variable pressure control valve controls the pressure of the fluid applied to the plurality of steering members through the solenoid valves sequentially.

12. A drilling system for drilling into an earthen formation, comprising;

a drill bit for coupling to a downhole end of the drill string;

a motor configured to power the drill bit; and a rotary steering tool attached to the drill string uphole from the drill bit, the rotary steering tool including:

a) a steering member configured to move between a retracted configuration and an extended configuration to contact a wall of a borehole in the earthen formation;

b) a pump configured to pump a fluid;

c) a power source independent of the downhole motor, the power source configured to power the pump;

d) a piston in fluid communication with the pump, the piston being configured to apply a force to the steering member in order to move the steering member from the retracted configuration into the extended configuration when the pump pumps the fluid at an operating system pressure;

e) a variable pressure control valve in fluid communication with the pump; and f) a controller configured to operate the variable pressure control valve at a range of operating system pressures, wherein the range of operating system pressures includes a minimum system pressure and a maximum system pressure, wherein the variable pressure control valve is configured to adjust the operating system pressure between the range of operating system pressures so as to adjust the force applied to the steering member by the piston, wherein a drilling direction of the drill bit changes when the steering member contacts the wall of the borehole of the earthen formation.

13. The drilling system of claim 12, wherein the variable pressure control valve is configured to adjust the operating system pressure from a first operating system pressure to a second operating system pressure that is different than the first operating system pressure, wherein the piston applies a first force to the steering member when the fluid is pumped at the first operating system pressure, and the piston applies a second force to the steering member when the fluid is pumped at the second operating system pressure.

14. The drilling system of claim 12, wherein the power source is configured to supply a current or voltage to the controller, which, in turn, supplies the current or the voltage to the variable pressure control valve, such that the power source is configured to cause the variable pressure control valve to adjust the operating system pressure.

15. The drilling system of claim 12, wherein the rotary steering tool further includes a controller configured to, in response to one or more inputs, cause the variable pressure control valve to adjust the operating system pressure.

16. The drilling system of claim 15, wherein the one or more inputs includes tool inclination, tool face angle, azimuth, temperature, pressure, drill string rotational speed, pump speed, mud motor speed, or an operator input.

17. The drilling system of claim 16, wherein the controller is configured to 1) compare the actual pressure to a predetermined pressure of the fluid, and 2) cause the variable pressure control valve to adjust the operating system pressure when the actual pressure differs from the predetermined pressure.

18. The drilling system of claim 15, wherein the rotary steering tool further includes a pressure transducer that is configured to detect an actual pressure of the fluid.

19. The drilling system of claim 15, further comprising a telemetry tool in communication with the controller, wherein the telemetry tool is configured to:

a) transmit an uplink signal indicative of the downhole characteristic to a system at a surface of the earthen formation; and b) to receive a downlink signal from a system at a surface of the earthen formation, wherein the downlink signal instructs the controller to cause the variable pressure control valve to adjust the operating system pressure.

20. The drilling system of claim 12, further comprising a plurality of solenoid valves associated with each one of the plurality of steering members, wherein the controller is configured to operate the plurality of solenoid valves, such that activation of the solenoid valves causes activation of the respective one of the plurality of steering members.

21. The drilling system of claim 20, wherein the controller is configured to operate the plurality of solenoid valves sequentially.

22. The drilling system of claim 20, wherein the variable pressure control valve controls the pressure of the fluid applied to the plurality of steering members through the solenoid valves sequentially.

23. A method of directing a drill bit coupled to a drill string drilling into an earthen formation during a drilling operation via a rotary steering tool, the method comprising:

pumping fluid through a hydraulic circuit of the rotary steering tool at a first operating system pressure, such that the fluid actuates a piston;

applying a first force to a steering member via the piston, such that the steering member moves between a retracted configuration and a first extended configuration to contact a wall of a borehole in the earthen formation;

adjusting the operating system pressure of the hydraulic circuit via a variable pressure control valve that is in fluid communication with the hydraulic circuit, such that the variable pressure control valve changes the operating system pressure from a first operating system pressure to a second operating system pressure;

pumping the fluid through the hydraulic circuit of the rotary steering tool at the second operating system pressure, such that the fluid actuates the piston; and applying a second force to the steering member via the piston, such that the steering member moves between the retracted configuration and a second extended configuration to contact the wall of the borehole in the earthen formation.

24. The method of claim 23, wherein adjusting the operating system pressure includes varying a DC current or voltage supplied to the variable pressure control valve from a power source.

25. The method of claim 24, wherein the controller is configured to autonomously cause the variable pressure control valve to change the operating system pressure.

26. The method of claim 25, further comprising transmitting an uplink signal indicative of the actual pressure from the electronic controller to a system at the surface of the earthen formation.

27. The method of claim 26, wherein the downhole characteristic is a drill bit acceleration, drill bit temperature, drill string RPM, or speed of a pump pumping the fluid.

28. The method of claim 26, further comprising transmitting an uplink signal indicative of the downhole characteristic from the controller to a system at a surface of the earthen formation.

29. The method of claim 28, wherein transmitting the downlink signal is performed by an EM telemetry tool, an MP telemetry tool, an acoustic telemetry tool, or a wired connection contained in the drill string.

30. The method of claim 24, further comprising:

measuring an actual pressure of the fluid via a transducer in fluid communication with the hydraulic circuit;

transmitting a signal indicative of the actual pressure from the transducer to the controller;

comparing the actual pressure to a predetermined pressure of the hydraulic circuit; and adjusting the operating system pressure of the hydraulic circuit via the variable pressure control valve when the actual pressure differs from the predetermined pressure.

31. The method of claim 24, wherein applying the first force to the steering member includes directing the drill bit in a first drilling direction and applying the second force to the steering member includes directing the drill bit in a second drilling direction, the method further comprising:

transmitting a downlink signal from a system at a surface of the earthen formation to the controller, wherein the downlink signal is indicative of the second drilling direction; and determining, via the controller, the operating system pressure that corresponds to the second drilling direction.

32. The method of claim 23, wherein adjusting the operating system pressure includes operating the variable pressure control valve via a controller to change the operating system pressure.

33. The method of claim 23, further comprising:

measuring a downhole characteristic of the drilling operation via a sensor; and transmitting a signal indicative of the downhole characteristic from the sensor to the controller, wherein adjusting the operating system pressure is performed in response to the electronic controller receiving the signal.

34. The method of claim 23, wherein the drill bit has a first build rate when the steering member is in the first extended configuration and a second build rate when the steering member is in the second extended configuration, wherein the first build rate is different than the second build rate.

35. The method of claim 23, directing a drill bit via rotatory drilling or rotation with a downhole motor.

* * * * *